US009562493B2

(12) United States Patent
Wakiya

(10) Patent No.: US 9,562,493 B2
(45) Date of Patent: Feb. 7, 2017

(54) COOLING STRUCTURE FOR CYLINDER HEAD

(71) Applicant: Tsutomu Wakiya, Toyota (JP)

(72) Inventor: Tsutomu Wakiya, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/433,740

(22) PCT Filed: Sep. 24, 2013

(86) PCT No.: PCT/JP2013/075674

§ 371 (c)(1),
(2) Date: Apr. 6, 2015

(87) PCT Pub. No.: WO2014/065057

PCT Pub. Date: May 1, 2014

(65) Prior Publication Data

US 2015/0247473 A1 Sep. 3, 2015

(30) Foreign Application Priority Data

Oct. 25, 2012 (JP) ..... 2012-235787

(51) Int. Cl.
*F02F 1/38* (2006.01)
*F01P 3/02* (2006.01)
(Continued)

(52) U.S. Cl.
CPC .. *F02F 1/38* (2013.01); *F01P 3/02* (2013.01); *F02F 1/243* (2013.01); *F02F 1/40* (2013.01);
(Continued)

(58) Field of Classification Search
CPC ..... F02F 1/10; F02F 1/38; F02F 1/40; F02F 1/243; F02F 2001/4278; F01P 3/02; F01P 2003/024; F01P 2003/027; F01P 2003/028; F01N 3/046
(Continued)

(56) References Cited

U.S. PATENT DOCUMENTS 5,379,729 A * 1/1995 Yonezwa ..... F01P 3/02 123/41.82 R
7,051,685 B2 * 5/2006 Hayman ..... F01N 3/043 123/41.82 R
(Continued)

FOREIGN PATENT DOCUMENTS

CN 101713349 A 5/2010
JP 56-157344 U 11/1981
(Continued)

OTHER PUBLICATIONS

International Search Report issued Dec. 10, 2013, in PCT/JP2013/075674, filed Sep. 24, 2013.
(Continued)

*Primary Examiner* — Grant Moubry
(74) *Attorney, Agent, or Firm* — Oblon, McClelland, Maier & Neustadt, L.L.P.

(57) ABSTRACT

A cooling structure for a cylinder head, wherein the cylinder head has formed therein an exhaust manifold having branch sections and also having a collecting section to which the branch sections connect; a first water jacket and a second water jacket, which cover the exhaust manifold; connection passages which supply cooling water in the second water jacket to the first water jacket; and a cooling water outlet which connects the first water jacket to the outside. The connection passages include the first connection passage which is closest to the collecting section, and the second connection passage which is located at the downstream end of each of the water jackets. The flow passage cross-sectional area of the second connection passage is set to be
(Continued)

less than the flow passage cross-sectional area of the first connection passage.

4 Claims, 3 Drawing Sheets

(51) Int. Cl.
*F02F 1/40* (2006.01)
*F02F 1/24* (2006.01)
*F02F 1/42* (2006.01)

(52) U.S. Cl.
CPC .. *F01P 2003/027* (2013.01); *F02F 2001/4278* (2013.01)

(58) Field of Classification Search
USPC ... 123/41.72, 41.82 R, 193.3, 193.5; 60/320, 60/321
See application file for complete search history.

(56) References Cited

U.S. PATENT DOCUMENTS

| | | | | |
|---|---|---|---|---|
| 7,367,294 | B2 * | 5/2008 | Rozario | F02F 1/4264 123/193.5 |
| 7,784,442 | B2 * | 8/2010 | Lester | F01N 3/046 123/193.5 |
| 8,047,177 | B2 * | 11/2011 | Kong | F01N 3/046 123/193.2 |
| 8,061,131 | B2 * | 11/2011 | Kuhlbach | F02F 1/243 123/193.5 |
| 8,146,543 | B2 * | 4/2012 | Kuhlbach | F02F 1/243 123/193.5 |
| 8,474,251 | B2 * | 7/2013 | Beyer | F01N 3/046 123/41.72 |
| 8,671,904 | B2 * | 3/2014 | D'Anna | F02F 1/40 123/193.5 |
| 2009/0126659 | A1 | 5/2009 | Lester et al. | |
| 2010/0083920 | A1 | 4/2010 | Kuhlbach | |
| 2011/0277723 | A1 | 11/2011 | Galeazzi et al. | |
| 2012/0060778 | A1 | 3/2012 | Kuhlbach | |
| 2012/0227686 | A1 | 9/2012 | D'Anna et al. | |
| 2014/0338314 | A1 | 11/2014 | Kuhlbach | |

FOREIGN PATENT DOCUMENTS

| | | |
|---|---|---|
| JP | 2-96449 | 8/1990 |
| JP | 6-221151 | 8/1994 |
| JP | 2005-188351 | 7/2005 |
| JP | 2007-162519 | 6/2007 |
| JP | 2007-278065 | 10/2007 |
| JP | 2009-47024 | 3/2009 |
| JP | 2009-115031 | 5/2009 |
| JP | 2010-275915 | 12/2010 |
| JP | 2011-202578 | 10/2011 |

OTHER PUBLICATIONS

Extended European Search Report issued Oct. 15, 2015 in Patent Application No. 13849755.7.
Combined Chinese Office Action and Search Report issued Sep. 29, 2015 in Patent Application No. 201380055145.5 (with English translation of categories of cited documents).

* cited by examiner

COOLING STRUCTURE FOR CYLINDER HEAD

FIELD OF THE INVENTION

The present disclosure relates to a cooling structure for cooling a cylinder head that accommodates an exhaust manifold.

BACKGROUND OF THE INVENTION

There is a recent cylinder head that accommodates an exhaust manifold. Japanese Laid-Open Patent Publication No. 2010-275915 describes a cylinder head in which upper and lower water jackets are respectively arranged above and below an exhaust manifold to cover the exhaust manifold. The exhaust manifold is cooled by a coolant flowing through each water jacket.

PRIOR ART DOCUMENT

Patent Document

Patent Document 1: Japanese Laid-Open Patent Publication No. 2010-275915

SUMMARY OF THE INVENTION

However, the temperature of an exhaust manifold is uneven. When such an exhaust manifold is uniformly cooled using a water jacket, a coolant is excessively supplied to a portion having a low temperature. This may result in insufficient cooling of a portion having a high temperature.

It is an object of the present disclosure to provide a structure for cooling a cylinder head accommodating an exhaust manifold that effectively cools a portion of the exhaust manifold having a high temperature.

One aspect of the present disclosure is a cooling structure for a cylinder head. The cylinder head accommodates an exhaust manifold, a first water jacket, a second water jacket, a plurality of communication passages, and a coolant outlet. The exhaust manifold includes a plurality of branches and a collector. The branches are respectively connected to combustion chambers of cylinders. The branches converge at the collector. The first water jacket is located above the exhaust manifold and covers the exhaust manifold including at least the collector. The second water jacket is located below the exhaust manifold and covers the exhaust manifold including at least the collector. The communication passages supply coolant from the second water jacket to the first water jacket. The coolant outlet connects the first water jacket to the exterior. The cooling structure for the cylinder head is configured so that the coolant flows from each water jacket in a direction in which the cylinders are arranged in order to be discharged out of the coolant outlet. The communication passages include a first communication passage and a second communication passage. The first communication passage is located at an upstream side of the collector in a flow direction of the coolant and arranged at a position that is the most proximate to the collector. The second communication passage is located in a downstream side end of each water jacket. A cross-sectional passage area of the second communication passage is set to be smaller than a cross-sectional passage area of the first communication passage.

Exhaust constantly flows to the collector of the exhaust manifold from one of the branches. Thus, the collector of the exhaust manifold tends to have a high temperature due to heat of the exhaust. In general, the exhaust manifold is curved so that a portion at a downstream side is located below a portion at an upstream side. Thus, the exhaust flowing to the exhaust manifold from the combustion chamber tends to strike an upper portion of an inner wall of the exhaust manifold. This causes the upper portion of the exhaust manifold to have a high temperature compared to a lower portion. More specifically, in the exhaust manifold, the collector, particularly, an upper portion of the collector, tends to have a high temperature.

In this regard, the configuration described above effectively cools the exhaust manifold, particularly, the upper portion of the collector, which tends to have a high temperature. More specifically, in the above configuration, a coolant supplied to a lower water jacket, which serves as the second water jacket, flows in the cylinder arrangement direction. Some of the coolant flows to the second communication passage arranged in the downstream side end of the second water jacket. Then, the coolant flows to an upper water jacket, which serves as the first water jacket, through the second communication passage and is discharged from the coolant outlet arranged in the first water jacket. In this case, the cross-sectional passage area of the second communication passage is set to be smaller than the cross-sectional passage area of the first communication passage. Thus, more coolant is supplied to the first water jacket from the second water jacket through the first communication passage than when a different setting is used. This increases a flow rate of the coolant flowing to a portion of the first water jacket that covers the upper portion of the collector. Consequently, the upper portion of the collector may be effectively cooled.

As described above, the upper portion of the exhaust manifold tends to have a high temperature compared to the lower portion. In this regard, in one mode, the first water jacket is set so that an area of the exhaust manifold that is covered by the first water jacket is larger than an area of the exhaust manifold that is covered by the second water jacket. This mode effectively cools the upper portion of the exhaust manifold, which tends to have a high temperature while limiting excessive cooling of the lower portion of the exhaust manifold.

In another mode, the communication passages include a third communication passage located at a downstream side of the collector in the flow direction of the coolant. The collector is located between the third communication passage and the first communication passage.

In this mode, the coolant is supplied to a portion that covers the two opposite sides of the collector through the first communication passage and the third communication passage. This effectively cools not only the upper side of the collector but also the sides of the collector.

In still another mode, the second communication passage includes a downstream side opening that opens to the first water jacket. The second communication is configured so that a flow passage direction of the downstream side opening extends toward the coolant outlet.

In this mode, the coolant, which is supplied to the first water jacket from the second communication passage, flows toward the coolant outlet. This generates flow of the coolant toward the coolant outlet in the first water jacket. Consequently, more coolant may be discharged to the exterior from the coolant outlet. This increases the amount of the coolant flowing through each of the water jackets, thereby effectively cooling the exhaust manifold.

Other aspects and advantages of the present disclosure will become apparent from the following description, taken in conjunction with the accompanying drawings, illustrating by way of example the principles of the present disclosure.

BRIEF DESCRIPTION OF THE DRAWINGS

Novel features of the present disclosure will become apparent from the accompanying claims. The invention, together with objects and advantages thereof, may best be understood by reference to the following description of the presently preferred embodiments together with the accompanying drawings in which:

DETAILED DESCRIPTION OF THE PREFERRED EMBODIMENTS

One embodiment of a cooling structure for a cylinder head will now be described with reference to FIGS. 1 to 6.

Figure 1:
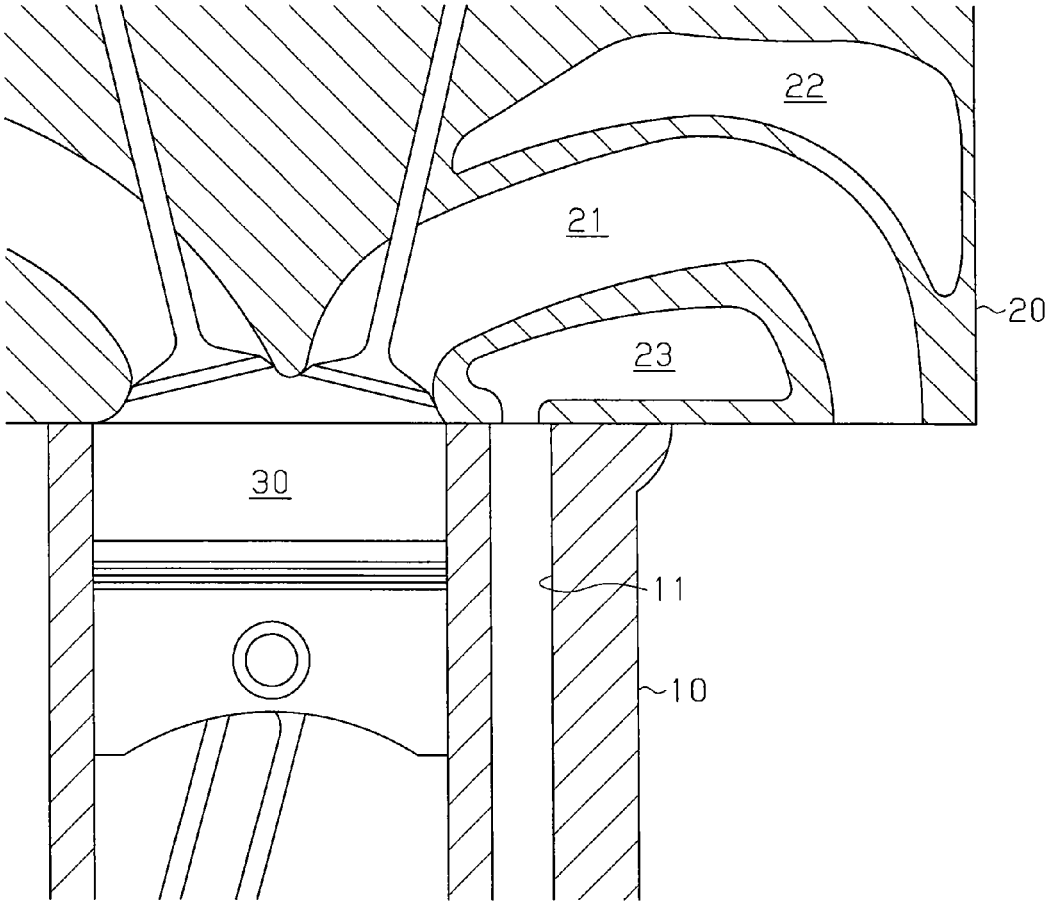
FIG. 1 is a schematic cross-sectional view showing the structure of one embodiment of a cooling structure for a cylinder head.

As shown in FIG. 1, a cylinder head 20 is arranged above a cylinder block 10 in an internal combustion engine. The cylinder head 20 includes an exhaust manifold 21 that is in communication with a combustion chamber 30. The exhaust manifold 21 is curved so that a portion at a downstream side of the exhaust is located below a portion at an upstream side of the exhaust, which is at the side of the combustion chamber 30. The cylinder head 20 includes an upper water jacket 22, which is arranged above the exhaust manifold 21 and serves as a first water jacket, and a lower water jacket 23, which is arranged below the exhaust manifold 21 and serves as a second water jacket. The lower water jacket 23 is in communication with a coolant passage 11 formed in the cylinder block 10.

The structure of each of the upper water jacket 22 and the lower water jacket 23 will now be described with reference to FIGS. 2 to 6.

Figure 2:
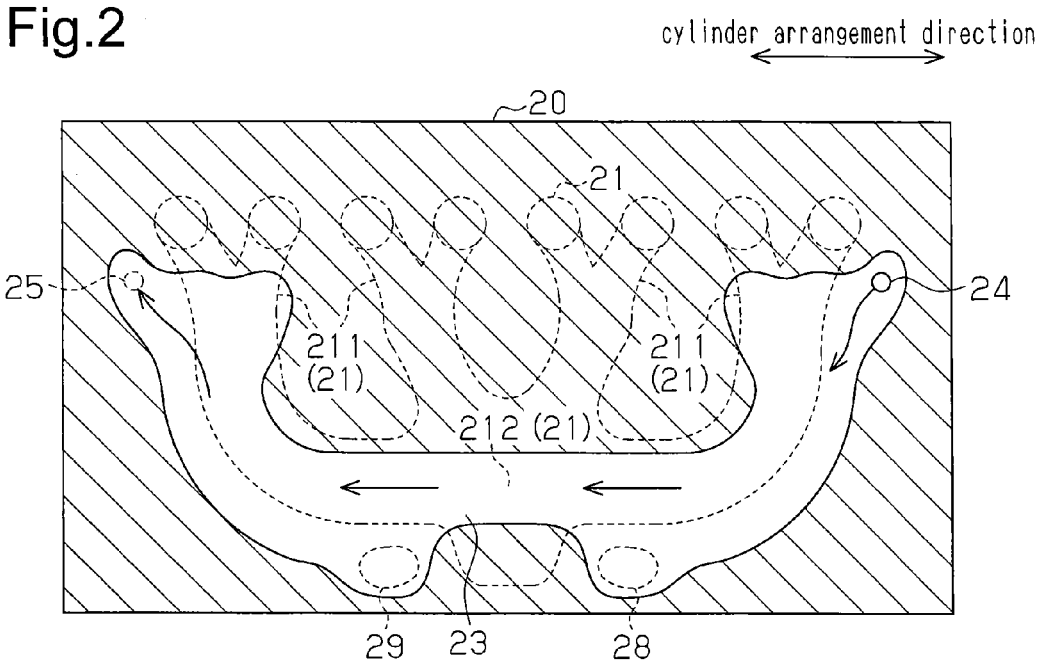
FIG. 2 is a cross-sectional view showing the structure of a lower water jacket of the embodiment of FIG. 1.

As shown in FIG. 2, the exhaust manifold 21 includes a plurality of branches 211, which are connected to the combustion chambers 30, and a collector 212. The branches 211 converge into the collector 212. The lower water jacket 23 extends in a direction in which cylinders are arranged (left-right direction in the drawing) and covers the collector 212 of the exhaust manifold 21 from a lower side. An area in which the lower water jacket 23 covers the exhaust manifold 21 is set to be 40% or less of the surface area of a lower portion of the exhaust manifold 21. The exhaust manifold 21, which is indicated by broken lines, includes a plurality of ends that are located below the lower water jacket 23 (located toward the cylinder block 10).

The lower water jacket 23 includes a first end and a second end in the cylinder arrangement direction (left-right direction in FIG. 2). The first end includes a first inlet 24 to which a coolant is supplied from the cylinder block 10. The second end includes a second communication passage 25 that is in communication with the upper water jacket 22. Thus, the coolant, which is supplied to the lower water jacket 23 from the first inlet 24, flows in the cylinder arrangement direction and is supplied to the upper water jacket 22 through the second communication passage 25.

The upper water jacket 22 will now be described with reference to FIG. 3.

Figure 3:
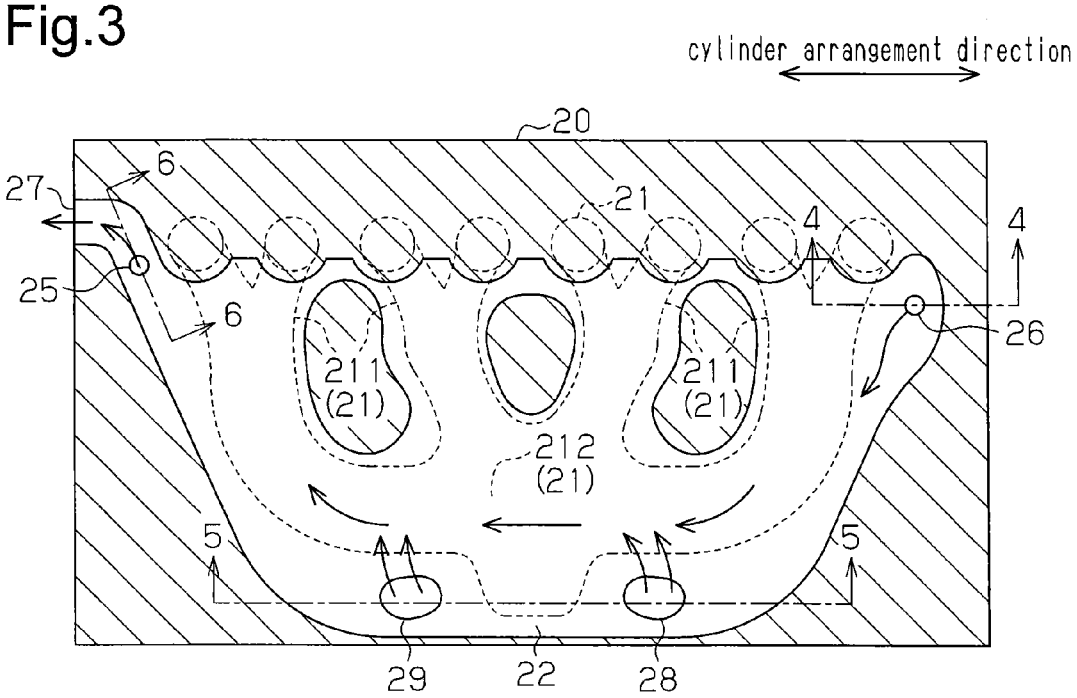
FIG. 3 is a cross-sectional view showing the structure of an upper water jacket of the embodiment of FIG. 1.

As shown in FIG. 3, the upper water jacket 22 extends in the cylinder arrangement direction (left-right direction in FIG. 3) and covers the substantially entire exhaust manifold 21 including the collector 212 from an upper side. The area in which the upper water jacket 22 covers the exhaust manifold 21 is set to be 70% or more of the surface area of an upper portion of the exhaust manifold 21. Thus, the area of the exhaust manifold 21 covered by the upper water jacket 22 is set to be larger than that covered by the lower water jacket 23.

The upper water jacket 22 includes a first end and a second end in the cylinder arrangement direction. The first end includes a second inlet 26 to which the coolant is supplied from the coolant passage 11 of the cylinder block 10. The second end is connected to the second communication passage 25 through which the coolant is supplied from the lower water jacket 23. The second end also includes a coolant outlet 27 that connects the upper water jacket 22 to the exterior. Thus, the coolant, which is supplied to the upper water jacket 22 from the second inlet 26 and the second communication passage 25, flows toward the coolant outlet 27 and is discharged from the coolant outlet 27 to, for example, a radiator arranged at an outer side.

As described above, in each of the water jackets 22, 23, the first end, which includes the first inlet 24 or the second inlet 26, corresponds to an upstream side end in a flow direction of the coolant. The second end, which includes the second communication passage 25, corresponds to a downstream side end in the flow direction of the coolant.

Figure 4:
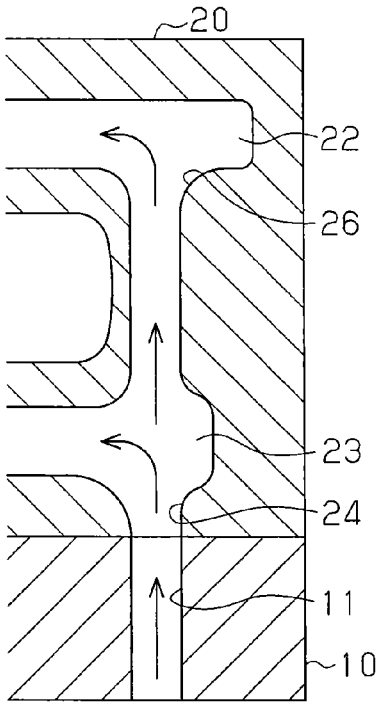
FIG. 4 is a cross-sectional view taken along line 4-4 of FIG. 3.

FIG. 4 is a cross-sectional view taken along line 4-4 of FIG. 3.

As shown in FIG. 4, the second inlet 26 of the upper water jacket 22 is in communication with the first inlet 24 of the lower water jacket 23. The first inlet 24 is in communication with the coolant passage 11 of the cylinder block 10. Thus, the coolant is supplied from the coolant passage 11 to each of the water jackets 22, 23 through each of the inlets 24, 26.

Further, as shown in FIGS. 2 and 3, the water jackets 22, 23 include a first communication passage 28 and a third communication passage 29. The coolant is supplied from the lower water jacket 23 to the upper water jacket 22 through the first communication passage 28 and the third communication passage 29 in addition to the second communication passage 25. The first communication passage 28 is located at an upstream side of the collector 212 in the flow direction of the coolant and arranged at a position that is the most proximate to the collector 212. The third communication passage 29 is located at a downstream side of the collector 212 in the flow direction of the coolant and arranged at a position where the distance from the third communication passage 29 to the collector 212 is substantially the same as the distance from the first communication passage 28 to the collector 212.

Figure 5:
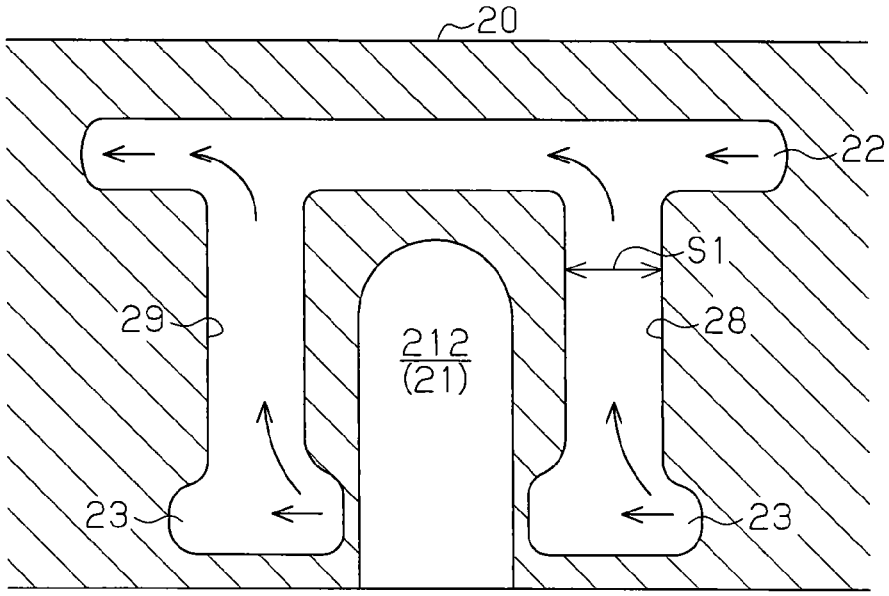
FIG. 5 is a cross-sectional view taken along line 5-5 of FIG. 3.

FIG. 5 is a cross-sectional view taken along line 5-5 of FIG. 3.

As shown in FIG. 5, the first communication passage 28 connects the two water jackets 22, 23 to each other at a location toward the upstream side from the collector 212. The third communication passage 29 connects the two water jackets 22, 23 to each other at a location toward the downstream side from the collector 212. That is, the collector 212 is located between the first communication passage 28 and the third communication passage 29. Thus, the upper water jacket 22, the first communication passage 28, and the third communication passage 29 are arranged to surround an upper side and two opposite sides of the collector 212.

Figure 6:
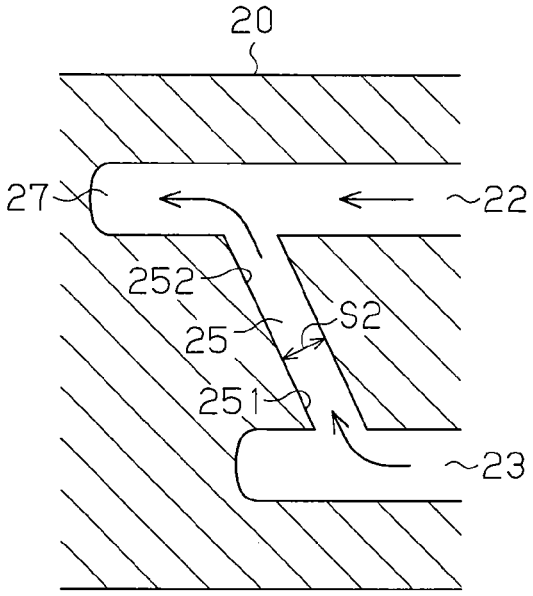
FIG. 6 is a cross-sectional view taken along line 6-6 of FIG. 3.

The second communication passage 25 will now be described with reference to FIG. 6. FIG. 6 is a cross-sectional view taken along line 6-6 of FIG. 3.

As shown in FIG. 6, the second communication passage 25 includes an upstream side opening 251 that opens to the lower water jacket 23 and a downstream side opening 252 that opens to the upper water jacket 22. The entire second communication passage 25 is inclined relative to the vertical direction (up-down direction in the drawing) so that the downstream side opening 252 is located closer to a side of the coolant outlet 27 than the upstream side opening 251 as viewed from the vertical direction (up-down direction in the drawing). More specifically, a coolant flow passage direction of the downstream side opening 252 extends toward the coolant outlet 27. The cross-sectional passage area S2 of the second communication passage 25 is set to be smaller than the cross-sectional passage area S1 (FIG. 5) of the first communication passage 28.

The operation of the cooling structure for the cylinder head 20, which is configured in the above manner, will now be described.

Exhaust constantly flows to the collector 212 of the exhaust manifold 21 from one of the branches 211. Thus, the collector 212 tends to have a high temperature due to heat of the exhaust. The exhaust manifold 21 is curved so that the downstream side portion is located below the upstream side portion. Thus, the exhaust flowing to the exhaust manifold 21 from the combustion chamber 30 tends to strike an upper portion of an inner wall of the exhaust manifold 21. This causes the upper portion of the exhaust manifold 21 to have a high temperature compared to a lower portion. More specifically, in the exhaust manifold 21, the collector 212, particularly, an upper portion of the collector 212, tends to have a high temperature.

As indicated by arrows of FIG. 2, in the present embodiment, when a coolant is supplied from the cylinder block 10 to the lower water jacket 23 through the first inlet 24 and flows toward the second communication passage 25, some of the coolant is supplied to the upper water jacket 22 from the first communication passage 28 and the third communication passage 29. In this case, the cross-sectional passage area S2 of the second communication passage 25 is set to be smaller than the cross-sectional passage area S1 of the first communication passage 28. Thus, more coolant is supplied to the upper water jacket 22 through the first communication passage 28 than when a different setting is used. This increases a flow rate of the coolant flowing to a portion of the upper water jacket 22 that covers the upper portion of the collector 212.

As described above, the upper portion of the exhaust manifold 21 tends to have a high temperature compared to the lower portion. In this regard, in the present embodiment, the area of the exhaust manifold 21 covered by the upper water jacket 22 is larger than the area of the exhaust manifold 21 covered by the lower water jacket 23. This increases the amount of the coolant flowing above the exhaust manifold 21 compared to the amount of the coolant flowing to the lower water jacket 23.

The cylinder head 20 is configured so that the collector 212 of the exhaust manifold 21 is located between the first communication passage 28 and the third communication passage 29. Thus, the coolant is supplied through the first communication passage 28 and the third communication passage 29 to a portion that covers the two opposite sides of the collector 212.

In the second communication passage 25, the flow passage direction of the downstream side opening 252, which opens to the upper water jacket 22, extends toward the coolant outlet 27. Thus, when flowing to the upper water jacket 22 from the second communication passage 25, the coolant flows toward the coolant outlet 27. This generates flow of the coolant toward the coolant outlet 27 in the upper water jacket 22. Consequently, more coolant is discharged to the exterior from the coolant outlet 27. This increases the amount of the coolant flowing through each of the water jackets 22, 23.

The embodiment, which has been described above, has the advantages described below.

(1) The present embodiment increases the flow rate of the coolant flowing to the portion of the upper water jacket 22 that covers the upper portion of the collector 212. This effectively cools the upper portion of the collector 212.

(2) The present embodiment effectively cools the upper portion of the exhaust manifold 21, which tends to have a high temperature, while limiting excessive cooling of the lower portion of the exhaust manifold 21.

(3) In the present embodiment, the coolant is supplied through the first communication passage 28 and the third communication passage 29 to a portion that covers the two opposite sides of the collector 212. This effectively cools not only the upper portion of the collector 212 but also the sides of the collector 212.

(4) The present embodiment increases the amount of the coolant flowing through each of the water jackets 22, 23. This effectively cools the exhaust manifold 21.

The embodiment may be modified as follows.

In the embodiment, the area of the exhaust manifold 21 covered by the lower water jacket 23 is set to be 40% or less of the surface area of the lower portion of the exhaust manifold 21. The area of the exhaust manifold 21 covered by the upper water jacket 22 is set to be 70% or more of the surface area of the upper portion of the exhaust manifold 21. However, the condition for the setting may be modified in accordance with various conditions, such as the degree of overheating of the exhaust manifold 21.

In each embodiment, the third communication passage 29 is located at the downstream side of the collector 212 and arranged at the position where the distance from the third communication passage 29 to the collector 212 is substantially the same as the distance from the first communication passage 28 to the collector 212. However, the distance from the third communication passage 29 to the collector 212 may be modified as long as the sides of the collector 212 can be cooled.

In each embodiment, the entire second communication passage 25 is inclined relative to the vertical direction so that the downstream side opening 252 is located closer to the side of the coolant outlet 27 than the upstream side opening 251 as viewed from the vertical direction. However, the flow passage direction may extend toward the coolant outlet 27 by inclining only the downstream side opening 252 or attaching another member to the interior of the downstream side opening 252. The flow passage direction of the downstream side opening 252, which opens to the upper water jacket 22, only needs to extend toward the coolant outlet 27.

In each embodiment, in at least one of the first communication passage 28, the third communication passage 29, and the second inlet 26, the flow passage direction of a portion that opens to the upper water jacket 22 may extend toward the coolant outlet 27.

In each embodiment, in the second communication passage 25, the flow passage direction of the downstream side opening 252, which opens to the upper water jacket 22, is set to extend toward the coolant outlet 27. However, this configuration may be omitted. Advantages (1) to (3) described above may be obtained even when this configuration is omitted.

The third communication passage 29 may be omitted from each embodiment. Advantages (1), (2), and (4) described above may be obtained even in a configuration in which the third communication passage 29 is omitted.

In each embodiment, when the temperature of the upper portion of the exhaust manifold 21 is not that high compared to the temperature of the lower portion, the area of the exhaust manifold 21 covered by the upper water jacket 22 may be set to be substantially the same as the area of the exhaust manifold 21 covered by the lower water jacket 23. Advantages (1), (3), and (4) described above may be obtained even when the above setting is used.

DESCRIPTION OF REFERENCE SYMBOLS

10 cylinder block
11 coolant passage
20 cylinder head
21 exhaust manifold
22 upper water jacket
23 lower water jacket
24 first inlet
25 second communication passage
26 second inlet
27 coolant outlet
28 first communication passage
29 third communication passage
30 combustion chamber
211 branch
212 collector
251 upstream side opening
252 downstream side opening

The invention claimed is:

1. A cooling structure for a cylinder head comprising in the cylinder head:

an exhaust manifold that includes a plurality of branches and a collector, wherein the branches are respectively connected to combustion chambers of cylinders, and the branches converge at the collector;

an upper water jacket and a lower water jacket located above and below the exhaust manifold, wherein each of the upper water jacket and the lower water jacket covers the exhaust manifold including at least the collector;

a plurality of communication passages including a first communication passage, a second communication passage, and a third communication passage, wherein each of the communication passages connects the lower jacket and the upper jacket to each other to supply coolant from the lower water jacket to the upper water jacket; and a coolant outlet that connects the upper water jacket to an exterior, wherein the cooling structure for the cylinder head is configured so that the coolant flows in each water jacket in a direction in which the cylinders are arranged in order to be discharged out of the coolant outlet, the first communication passage is located at an upstream side of the collector in a flow direction of the coolant, a first distance between the first communication passage and the collector is shorter than a second distance between the first communication passage and an upstream side end of each water jacket, the second communication passage is located in a downstream side end of each water jacket, and the third communication passage is located at a downstream side of the collector in the flow direction of the coolant, wherein the collector is located between the third communication passage and the first communication passage, and a cross-sectional passage area of the second communication passage is set to be smaller than a cross-sectional passage area of the first communication passage.

2. The cooling structure for a cylinder head according to claim 1, wherein the upper water jacket is set so that the upper water jacket covers a larger area of the exhaust manifold than the lower water jacket does.

3. The cooling structure for a cylinder head according to claim 1, wherein the second communication passage is configured so that a flow passage direction of a downstream side opening, which opens to the upper water jacket, extends toward the coolant outlet.

4. The cooling structure for a cylinder head according to claim 1, wherein a third distance between the third communication passage and the collector is substantially the same as the first distance.

* * * * *